United States Patent [19]

Chiles et al.

[11] Patent Number: 4,742,803

[45] Date of Patent: May 10, 1988

[54] RECIPROCATORY INTERNAL COMBUSTION ENGINE

[75] Inventors: Christopher J. W. Chiles, Finham; Robert J. Watkinson, Bournville, both of United Kingdom

[73] Assignee: Jaguar Cars Limited, Coventry, England

[21] Appl. No.: 20,529

[22] Filed: Mar. 2, 1987

[30] Foreign Application Priority Data

Mar. 26, 1986 [GB] United Kingdom ..... 8607542

[51] Int. Cl.[4] ..... F01M 1/00; F01M 1/06

[52] U.S. Cl. ..... 123/196 M; 123/41.35; 123/41.39; 123/196 AB; 184/6.8

[58] Field of Search ..... 123/196 M, 41.35, 41.39; 184/6.8

[56] References Cited

U.S. PATENT DOCUMENTS

| | | | |
|---|---|---|---|
| 2,638,081 | 5/1953 | Spannhake | 123/668 |
| 2,991,770 | 7/1961 | Rausch | 184/6.8 |
| 3,996,913 | 12/1976 | Hamparian | 123/668 |
| 4,280,455 | 7/1981 | Yamaguchi | 123/41.39 |
| 4,377,967 | 3/1983 | Pelizzoni | 123/41.35 |

FOREIGN PATENT DOCUMENTS

| | | |
|---|---|---|
| 829971 | 3/1960 | United Kingdom . |
| 1238153 | 7/1970 | United Kingdom . |
| 1558393 | 1/1980 | United Kingdom . |

*Primary Examiner*—E. Rollins Cross
*Attorney, Agent, or Firm*—Solon B. Kemon

[57] ABSTRACT

A reciprocating internal combustion engine comprises a cylinder block having at least one bore formed therein and a cylinder liner fitted into each bore. The cylinder liner defines a cylinder in which a piston is slideable, with a combustion chamber being disposed to one side of the piston and a crank mechanism to the other side. An annular groove is provided at the mating surfaces of the cylinder liner and the cylinder block, for example in the outer surface of the liner, and at least one lubricant discharge nozzle is provided in the cylinder liner in communication with the annular groove and opening on the crank side of the piston when the piston is at the combustion chamber end of its stroke. The nozzle is angled towards the combustion chamber such as to discharge lubricant onto the crank side of the piston.

6 Claims, 1 Drawing Sheet

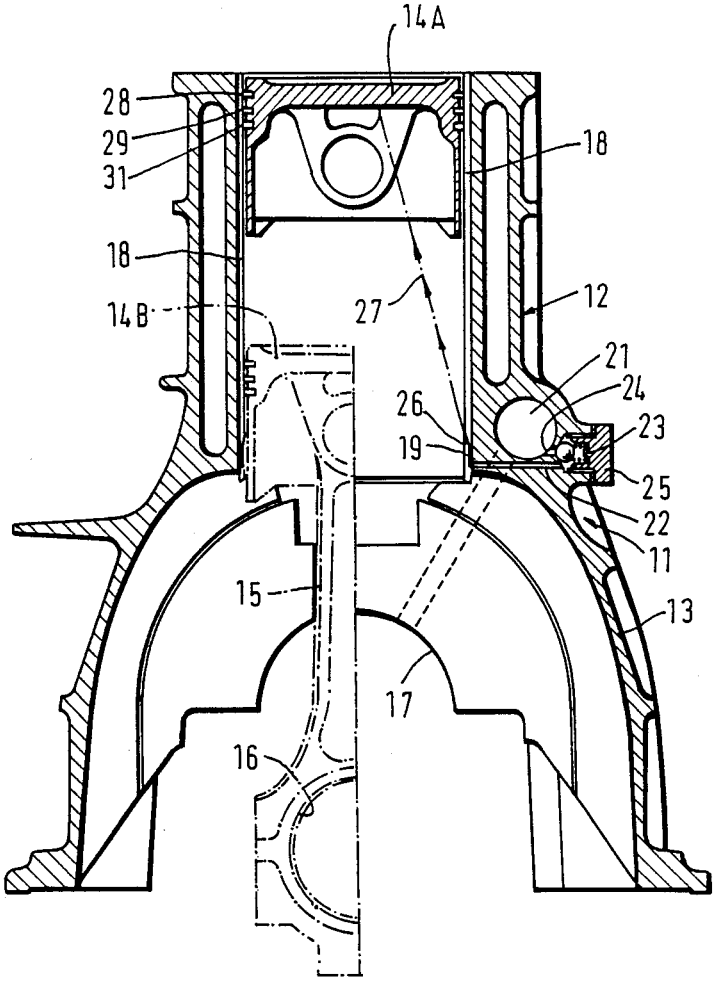
14A
28
29
31
18
18
14B
27
12
21
24
26
23
19
25
22
11
15
13
17
16

RECIPROCATORY INTERNAL COMBUSTION ENGINE

FIELD OF THE INVENTION

The invention relates to reciprocatory internal combustion engines and in particular to an arrangement for cooling a piston of such an engine.

BACKGROUND OF THE INVENTION

A conventional reciprocatory internal combustion engine has a piston slideable in a cylinder, a combustion chamber to one side of the piston and a crank mechanism to the other side of the piston. Throughout this specification the two sides of the piston will be called respectively the combustion side and the crank side. In the case of a vertical engine these are normally the top and the bottom of the piston.

DESCRIPTION OF PRIOR ART

There is a tendency, particularly with high performance engines for the piston to become overheated so a cooling arrangement is desirable. It is known to provide piping and associated nozzles within the crank case of an engine such that a jet of lubricant is caused to impinge on the under surface of the piston to cool it and also to provide some lubrication for the small end bearing of the connecting rod.

A disadvantage of such pipes and nozzles is that they constitute a number of fairly delicate components which can add to direct component costs, require extra care in engine assembly and can fail during the life of the engine.

OBJECT OF THE INVENTION

An object of the present invention is to provide an improved means for cooling the crank side of the piston.

SUMMARY OF THE INVENTION

In accordance with the present invention there is provided a reciprocatory internal combustion engine comprising a cylinder block having at least one bore formed therein, and a cylinder liner fitted into the or each bore and defining a cylinder in which a piston is slideable, there being a combustion chamber to one side of the piston and a crank mechanism to the other side of the piston, wherein an annular groove is provided at the mating surfaces of the cylinder liner and the cylinder block and at least one lubricant discharge nozzle is provided in the cylinder liner in communication with the annular groove and opening on the crank side of the piston when the piston is at the combustion chamber end of its stroke, the nozzle being angled towards the combustion chamber such as to discharge lubricant on the crank side of the piston.

Preferably a plurality of nozzles are spaced around the cylinder wall.

Preferably the groove is in the outer surface of the cylinder liner.

Preferably the annular groove connects with an oil gallery in the cylinder block through a passage in the block.

A threshold pressure valve may be provided in the lubricant supply to the nozzle or nozzles such that no lubricant supply is available to the nozzle or nozzles until a threshold pressure has built up for lubrication of other parts of the engine.

The nozzle or nozzles may be positioned such that the piston at the end of its stroke remote from the combustion chamber overlaps the nozzle or nozzles so that in this position of the piston lubricant is supplied directly to the walls of the piston.

BRIEF DESCRIPTION OF THE DRAWINGS

An embodiment of the invention will now be described by way of example only with reference to the accompanying drawing which is diagrammatic cross-section through the relevant parts of an engine incorporating the invention.

DESCRIPTION OF PREFERRED EMBODIMENT

This example describes the application of the invention to a multi-cylinder water-cooled in-line vertical engine but the invention could equally be applied to other engine configurations. Only one cylinder and its associated parts are shown, although in practice a larger number of cylinders will be incorporated into the engine.

A cylinder block 11 incorporates an upper part 12 incorporating the cylinders themselves and a lower crank-case part 13 housing a conventional crank shaft which is not shown in detail. A piston 14 is shown in full as 14A at top dead centre (TDC) namely the combustion chamber end of its stroke. The piston is also shown in chain dotted outline as 14B at bottom dead centre (BDC). At BDC the piston is shown connected by a connecting rod 15 to a big end bearing 16 of an engine crank shaft. The part circle 17 represents a main bearing position for the crank shaft.

Other parts of the engine such as a sump on the lower end of the block and a cylinder head with its valves and valve operating mechanism are not shown.

In this example, the cylinder wall is defined by a cylinder liner 18 fitted into a bore in the block 12. Very close to the lower end of the liner, an annular groove 19 is provided around its outer periphery. This groove is arranged to communicate with an oil gallery 21 through a transverse drilling 22, a pressure threshold valve 23 and a further transverse drilling 24. The valve 23 is arranged close to an outer surface of the engine and is enclosed by a threaded cap 25 which gives access for servicing and also provides access for drilling the passages 22 and 24. The oil gallery 21 is supplied by oil under pressure from an engine driven oil pump (not shown) in the usual way. Valve 23 closes off all oil supply from the gallery to the annular groove 19 until a threshold pressure is reached. This ensures that priority is given at low pressure, particularly on start-up, to other parts of the engine. The threshold pressure valve 23 also acts as a pressure relief valve for limiting pressure supplied to other parts of the engine in that any volume of pumped oil beyond that required to achieve the threshold pressure is relieved to the groove 19. As there is some constriction in the flow to and through the annular groove 19 as will be explained subsequently, valve 23 does not positively restrict pressure in the gallery to the threshold level.

A series of for example six angled nozzles 26 lead from the annular groove 19 at equally spaced positions around its periphery. These nozzles pass through the liner to the cylinder wall and tend to direct a jet of oil in an upwardly inclined direction on to the under side (the crank side) of the piston as indicated by line 27. As the piston rises and falls, the position at which each jet impinges on the piston moves across the under surface of the piston. As the piston approached BDC, the jets impinge directly on the outer surface of the piston as shown for the nozzle to the left of the drawing in relation to the piston at position 14B.

The piston incorporates the ususal compression rings 28 and 29 and an oil control ring 31. The arrangement is such that the oil control ring 31 remains above the nozzles at BDC.

The jets of oil impinging on the under side of the piston serve to cool it and also to lubricate its small end bearing. The jets also supply oil to the outer surface of the piston which tends to be pulled up inside the cylinder by movement of the piston and thus tends to lubricate the cylinder wall. In an alternative construction, one or more of the jets could be angled such as to impinge directly on the cylinder liner immediately below the piston at BDC. In such a case the jets still impinge on the under side of the piston when the piston is nearer to BDC.

In this way, an effective means of lubricating and cooling the piston is provided, without the provision of any pipes and nozzles in the open space in the crank case below the piston at BDC.

In an alternative, the groove 19 could be arranged in the cylinder wall.

I claim:

1. A reciprocatory internal combustion engine comprising:

a cylinder block having at least one bore formed therein;

a cylinder liner fitted into each of said at least one bore and defining a cylinder;

a piston slideably mounted in each said cylinder liner;

a combustion chamber to one side of each said piston;

a crank mechanism to the other side of each said piston;

an annular groove provided at mating surfaces of each said cylinder liner and said cylinder block; and at least one lubricant discharge nozzle provided in each said cylinder liner in communication with said annular groove and opening into the cylinder on the crank side of the piston when the piston is at the combustion chamber end of its stroke, each said lubricant discharge nozzle being angled towards the combustion chamber such as to discharge lubricant onto the crank side of the piston.

2. An engine according to claim 1 and including a plurality of lubricant discharge nozzles spaced around the cylinder liner.

3. An engine according to claim 1, wherein the annular groove is formed in the outer surface of the cylinder liner.

4. An engine according to claim 3, wherein the annular groove connects with an oil gallery in the cylinder block by way of a passage in the block.

5. An engine according to claim 1 and including a threshold pressure valve provided in a lubricant supply to each said nozzle such that no lubricant supply is available to each said nozzle until a threshold pressure has built up for lubrication of other parts of the engine.

6. An engine according to claim 1, wherein said nozzle is positioned such that the piston at the end of its stroke remote from the combustion chamber overlaps each said nozzle so that in this position of the piston lubricant is supplied directly to the walls of the piston.

* * * * *